US007697286B2

(12) United States Patent
Hung

(10) Patent No.: US 7,697,286 B2
(45) Date of Patent: Apr. 13, 2010

(54) FAN HOLDER

(75) Inventor: Chen-Kai Hung, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 144 days.

(21) Appl. No.: 12/123,621

(22) Filed: May 20, 2008

(65) Prior Publication Data

US 2009/0219688 A1 Sep. 3, 2009

(51) Int. Cl.
*H05K 7/20* (2006.01)

(52) U.S. Cl. ..... 361/694; 361/695; 361/693; 361/692; 454/184; 415/206

(58) Field of Classification Search ..... 361/692, 361/694, 695; 454/184; 415/200, 203, 206
See application file for complete search history.

(56) References Cited

U.S. PATENT DOCUMENTS 5,788,566 A * 8/1998 McAnally et al. ..... 454/184
6,373,698 B1 * 4/2002 Christensen ..... 361/695
6,537,019 B1 * 3/2003 Dent ..... 415/61
6,556,437 B1 * 4/2003 Hardin ..... 361/679.48
6,611,427 B1 * 8/2003 Liao ..... 361/695
6,735,078 B2 * 5/2004 Tsai ..... 361/695
7,251,135 B2 * 7/2007 Crippen et al. ..... 361/695
7,379,300 B1 * 5/2008 Chen ..... 361/695
7,385,814 B1 * 6/2008 Chen ..... 361/695
7,450,379 B2 * 11/2008 Chen et al. ..... 361/695
7,494,408 B2 * 2/2009 Chen et al. ..... 454/184
2007/0212219 A1 * 9/2007 Teshima et al. ..... 415/206

* cited by examiner

*Primary Examiner*—Dameon E Levi
(74) *Attorney, Agent, or Firm*—D. Austin Bonderer

(57) ABSTRACT

A fan holder for mounting a fan, includes two opposite sidewalls defining a receiving area therebetween, each of the sidewalls defining a through hole therein; two or more polygonal auxiliary members arranged in the through hole of each of the sidewalls and located about an axis; and wherein the polygonal auxiliary members are rotationally offset from each other.

8 Claims, 4 Drawing Sheets

FAN HOLDER

BACKGROUND

1. Field of the Invention

The present invention relates to fan holders, and particularly to a fan holder capable of alleviating noise disturbances caused by the fan.

2. Description of Related Art

Traditionally, a fan is mounted to an electronic device for dissipating large amounts of heat generated by components of the electronic device. The fan is generally mounted to the electronic device via a bracket. The bracket defines two circular openings in opposite sides thereof. An inlet of the fan aligns with one of the openings of the bracket, and an outlet of the fan aligns with the other opening of the bracket.

Generally, the vibration generated from the movement of the fan, along with air passing therethrough, may lead to noise disturbances.

Consequently, it is desired to provide a fan holder capable of alleviating noise disturbances caused by the fan.

SUMMARY

In one embodiment, a fan holder for mounting a fan, includes two opposite sidewalls defining a receiving area therebetween, each of the sidewalls defining a through hole therein; two or more polygonal auxiliary members arranged in the through hole of each of the sidewalls and located about an axis; and wherein the polygonal auxiliary members are rotationally offset from each other.

Other advantages and novel features of the present invention will become more apparent from the following detailed description of embodiment when taken in conjunction with the accompanying drawings, in which:

DETAILED DESCRIPTION

Figure 1:
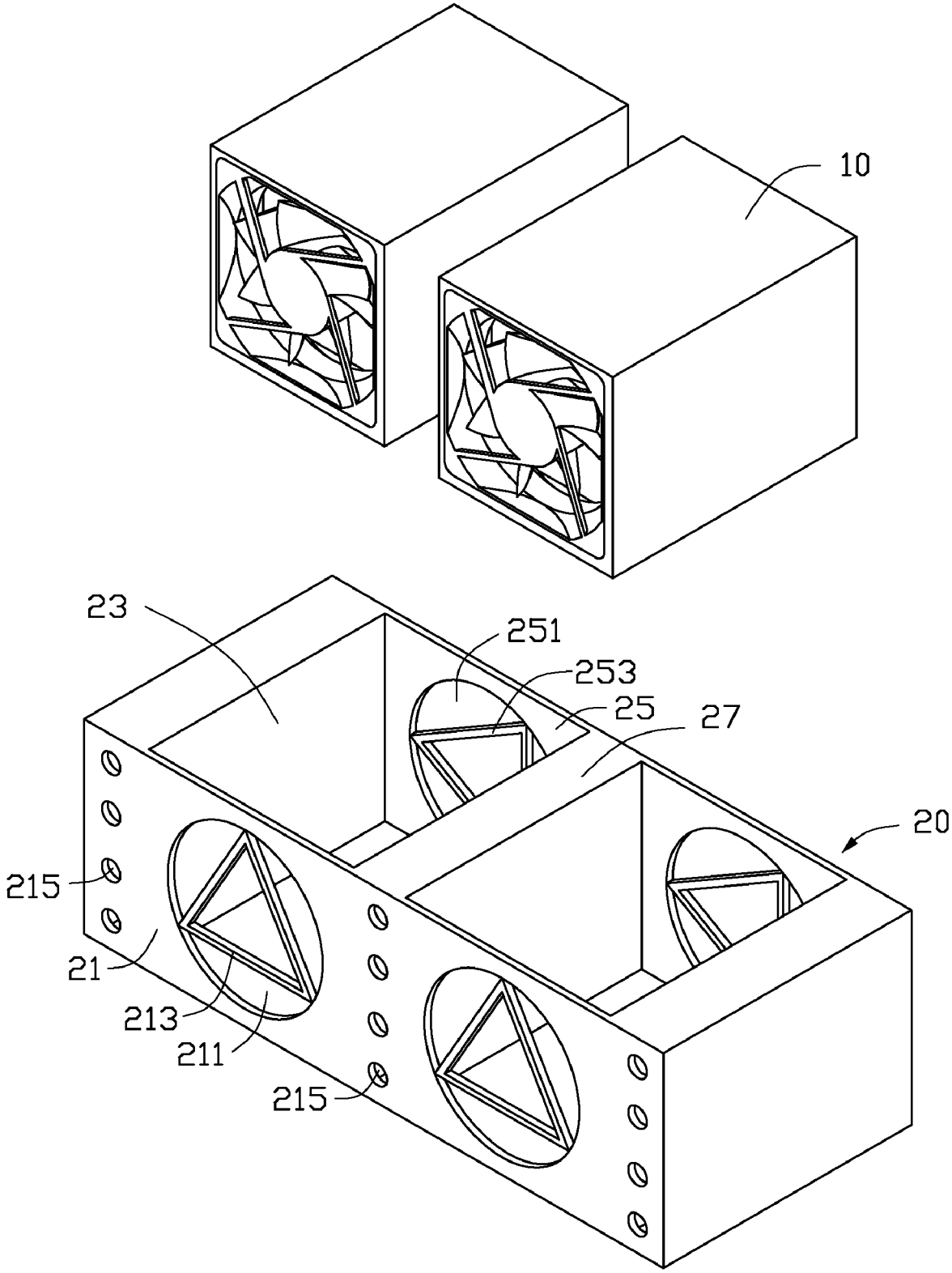
FIG. 1 is an isometric view of a fan holder according to a first embodiment of the present invention, together with two fans.

Referring to FIG. 1, in a first embodiment of the present invention, a fan holder 20 is provided for mounting a fan 10. The fan holder 20 includes a bottom wall (not labeled), a first sidewall 21, a second sidewall 23, a third sidewall 25, and a fourth sidewall 27. The four sidewalls 21, 23, 25, 27 extend up from four sides of the bottom wall, respectively. The first sidewall 21 is opposite to the third sidewall 25. The second sidewall 23 is opposite to the fourth sidewall 27 and comprise a hollow section. A receiving space is surrounded by the bottom wall and the four sidewalls 21, 23, 25, 27. An opening opposite to the bottom wall is defined in a top of the fan holder 20, for the fan 10 passing therethrough to enter into the receiving space. The first sidewall 21 defines an air inlet 211 therein, and the third sidewall 25 defines an air outlet 251 therein aligning with the air inlet 211. Two triangular auxiliary members 213, 253 are arranged in the air inlet 211 and the air outlet 251 respectively. Three corners of each of the auxiliary members 213, 253 are connected to a circumference of a corresponding air inlet 211 or air outlet 251. Each of the auxiliary members 213, 253 includes three flanges connected end to end. Each flange of the auxiliary member 213 is not parallel to any one of the flanges of the auxiliary member 253. Thus the triangular auxiliary members 213 and 215 are offset from each other.

Figure 2:
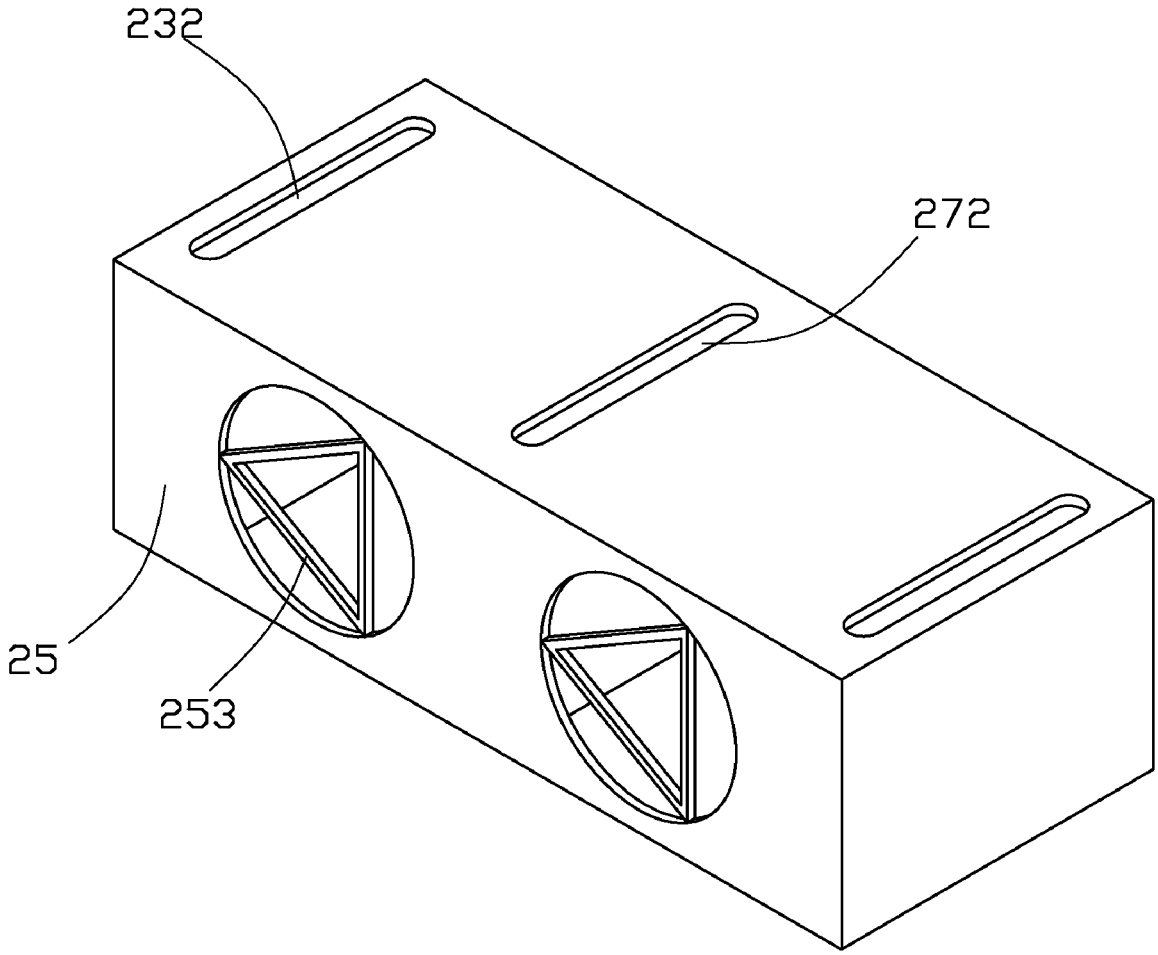
FIG. 2 is an isometric view of the fan holder of FIG. 1, but viewed from another aspect.
Figure 4:
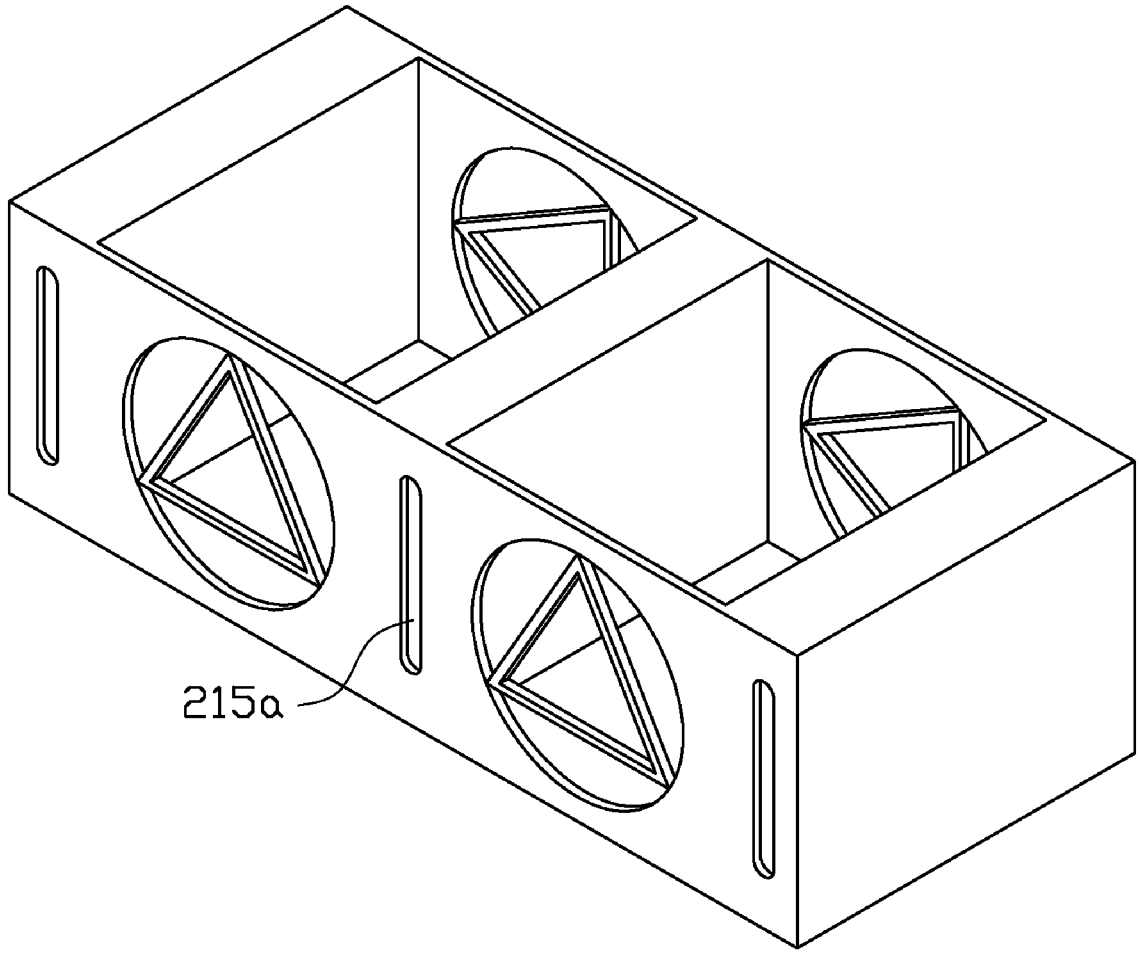
FIG. 4 is an isometric view of a fan holder according to a third embodiment of the present invention.

Referring also to FIG. 2, the second sidewall 23 and the fourth sidewall 27 are hollow, each with an opening 232, 272 defined in a bottom thereof for communicating with an inner space of the second and fourth sidewalls 23, 27. A plurality of through holes 215 is defined in the first sidewall 21 at opposite sides of the air inlet 211 and communicates with the inner spaces of the second and fourth sidewalls 23, 27, respectively. Two elongate through holes defined at opposite sides of the air inlet 211 are capable of substituting for the through holes 215 of the first sidewall 21, as shown in FIG. 4.

In assembling the fan 10 to the fan holder 20, the fan 10 passes through the opening at the top of the fan holder 20 to be accommodated in the receiving space of the fan holder 20, with an air inlet thereof aligning with the air inlet 213 of the first sidewall 21 of the fan holder 20, and an air outlet thereof aligning with the air outlet 253 of the third sidewall 25 of the fan holder 20. While in use, air outside of the first sidewall 21 is sucked into the fan 10 through the air inlet 211 of the fan holder 20. Air below the fan holder 20 is also sucked into the fan 10 through the openings 232, 272 at the bottoms of the second and fourth sidewalls 23, 27, the inner space of the second and fourth sidewalls 23, 27, the through holes 215 of the first sidewall 21, and the air inlet 211 of the first sidewall 21. Therefore, there is enough air being sucked into the fan 10. A phase of each of the auxiliary members 213, 253 of the fan holder 20 is different from a phase of blades of the fan 10. As a result, noise caused by the fan 10 is reduced, and a better dynamic balance of the holder 20 is achieved.

Figure 3:
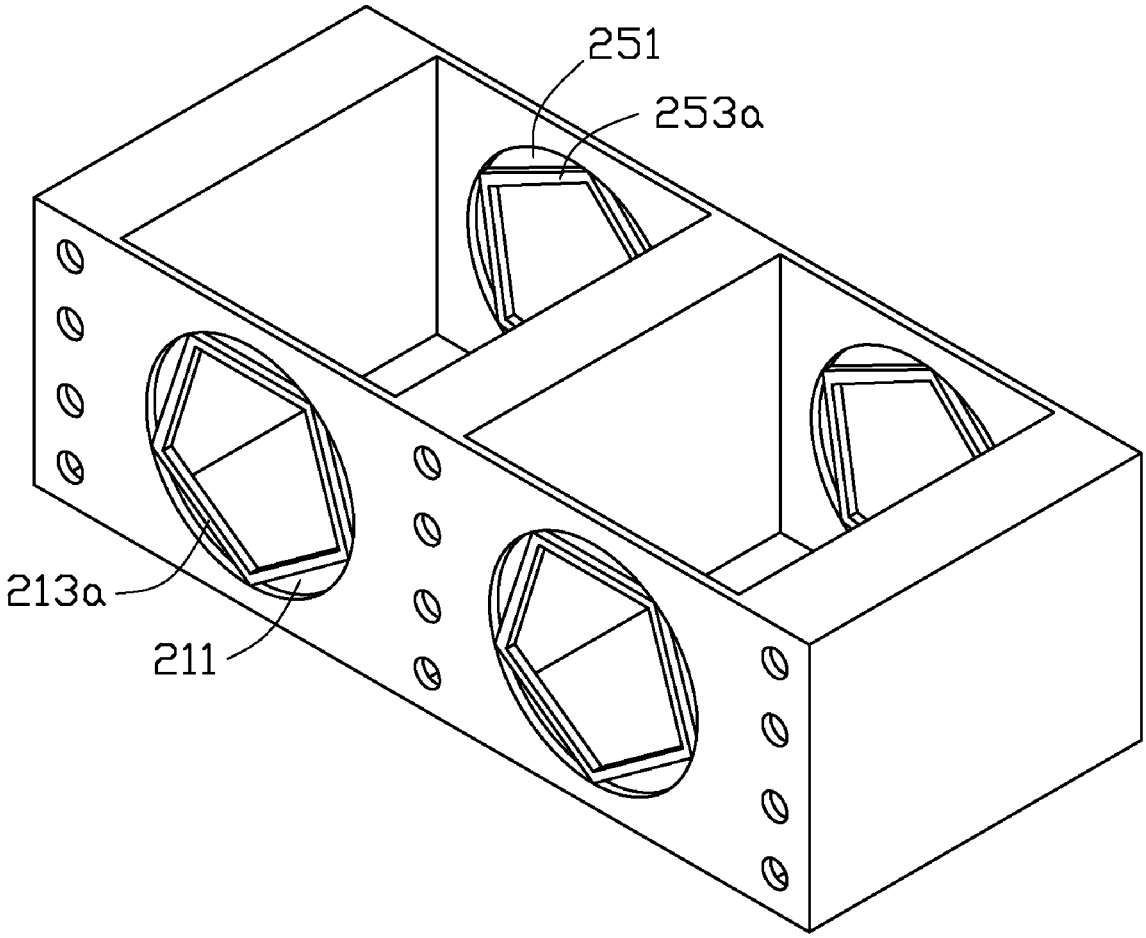
FIG. 3 is an isometric view of a fan holder according to a second embodiment of the present invention.

Referring to FIG. 3, in a second embodiment of the present invention, two pentagonal auxiliary members 213*a*, 253*a* are arranged in the air inlet 211 and the air outlet 251, respectively. Five corners of each of the auxiliary members 213*a*, 253*a* are connected to a circumference of a corresponding air inlet 211 or air outlet 251. Each of the auxiliary members 213*a*, 253*a* includes five flanges connected end to end. Each flange of the auxiliary member 213*a* is not parallel to any one of the flanges of the auxiliary member 253*a*. Therefore, the auxiliary members 213*a*, 253*a* may take the shape of any polygon.

In the present invention, a testing method uses a head measure system (HMS) for testing the sound quality of the fan in a half-silent room. A spectrum analyzer is used for a series of analyses. The testing method includes the following steps:

- putting an assembly of the fan and the fan holder into the half-silent room;
- testing the sound of the fan via a head-shaped microphone;
- analyzing the sound of the fan via the spectrum analyzer; and
- computing the modulation (modulation is a criterion of the sound quality in Psychoacoustics, a smaller modulation value is associated with a lesser degree of noise) of the sound.

Seven traditional holders together with seven types of fans being respectively mounted thereto, and seven holders of this present invention together with seven types of fans being respectively mounted thereto are put in a same testing system, values of the modulations of the fans as following:

| holders | fan types 1 | 2 | 3 | 4 | 5 | 6 | 7 |
|---|---|---|---|---|---|---|---|
| holders of this present invention | 27.83 | 28.65 | 30.00 | 28.87 | 28.42 | 31.90 | 29.26 |
| holders of prior art | 35.72 | 32.16 | 30.35 | 32.81 | 35.69 | 34.08 | 37.01 |

As shown in the above table, the modulation of the holder mounting a type of fan of this present invention is smaller than the modulation of the traditional holder mounting a same type of fan. Therefore, the holders of this present invention produce a lower level of noise disturbances compared to that of traditional holders.

While several embodiments have been disclosed, it is understood that any element disclosed in any one embodiment is easily adapted to other embodiments. It is also to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan holder for mounting a fan, comprising:

two opposite sidewalls defining a receiving area therebetween, each of the sidewalls defining a through hole therein;

three or more polygonal auxiliary members arranged in the through hole of each of the sidewalls and located about an axis;

and wherein the polygonal auxiliary members are rotationally offset from each other.

2. The fan holder as described in claim 1, wherein the auxiliary members are triangular and the corners are connected to a circumference of the corresponding through hole.

3. The fan holder as described in claim 1, wherein the auxiliary members are pentagonal and the five corners of the auxiliary member are connected to a circumference of the corresponding through hole.

4. The fan holder as described in claim 1, wherein the through holes are circular and are centered about the axis.

5. The fan holder as described in claim 1, wherein the polygonal auxiliary members comprise of flanges that are not parallel to any flanges of other auxiliary members.

6. The fan holder as described in claim 1, further comprising two hollow sections that define an inner space; an opening located on the bottom of each of the hollow sections; the openings provide communication between the inner spare of the hollow section and the receiving area.

7. The fan holder as described in claim 6, further comprising a through hole defined on an external surface of the hollow sections; wherein the through hole extends from the external surface to the inner space.

8. The fan holder as described in claim 7, wherein the hollow sections are not fully enclosed.

* * * * *